US008220407B2

(12) United States Patent
Williams et al.

(10) Patent No.: US 8,220,407 B2
(45) Date of Patent: Jul. 17, 2012

(54) BATTERED COLUMN SEMI-SUBMERSIBLE OFFSHORE PLATFORM

(75) Inventors: Anthony Neil Williams, Houston, TX (US); Amir Homayoun Heidari, Houston, TX (US); Sean Large, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 12/945,396

(22) Filed: Nov. 12, 2010

(65) Prior Publication Data

US 2011/0114005 A1 May 19, 2011

Related U.S. Application Data

(63) Continuation of application No. 11/868,960, filed on Oct. 8, 2007, now abandoned.

(51) Int. Cl.
*B63B 35/44* (2006.01)

(52) U.S. Cl. ..... 114/265; 405/195.1

(58) Field of Classification Search ..... 114/122, 114/264–266; 405/195.1–208, 223.1–224.4
See application file for complete search history.

(56) References Cited

U.S. PATENT DOCUMENTS

| | | | | |
|---|---|---|---|---|
| 6,447,208 | B1 * | 9/2002 | Huang et al. | 405/224 |
| 6,997,132 | B2 * | 2/2006 | Steen | 114/265 |
| 7,011,472 | B2 * | 3/2006 | Martensson et al. | 405/205 |
| 7,117,810 | B2 * | 10/2006 | Kristensen et al. | 114/265 |
| 7,140,317 | B2 * | 11/2006 | Wybro et al. | 114/264 |
| 7,462,000 | B2 * | 12/2008 | Leverette et al. | 405/223.1 |
| 7,900,572 | B2 * | 3/2011 | Leverette | 114/264 |
| 2001/0026733 | A1 * | 10/2001 | Ludwigson | 405/224.2 |
| 2009/0229505 | A1 * | 9/2009 | Williams et al. | 114/265 |

* cited by examiner

*Primary Examiner* — Ajay Vasudeva
(74) *Attorney, Agent, or Firm* — Nick A. Nichols, Jr.

(57) ABSTRACT

A semisubmersible platform includes a deck supported on the upper ends of support columns extending upwardly from a horizontally disposed pontoon-ring. The columns are battered inwardly and upwardly from the pontoon-ring to the deck. Mooring lines passing through fair leads on the outer faces of the base nodes anchor the platform to the seabed. The footprint of the battered columns is greater than the footprint of the deck supported on the upper ends of the columns.

7 Claims, 2 Drawing Sheets

FIG.1
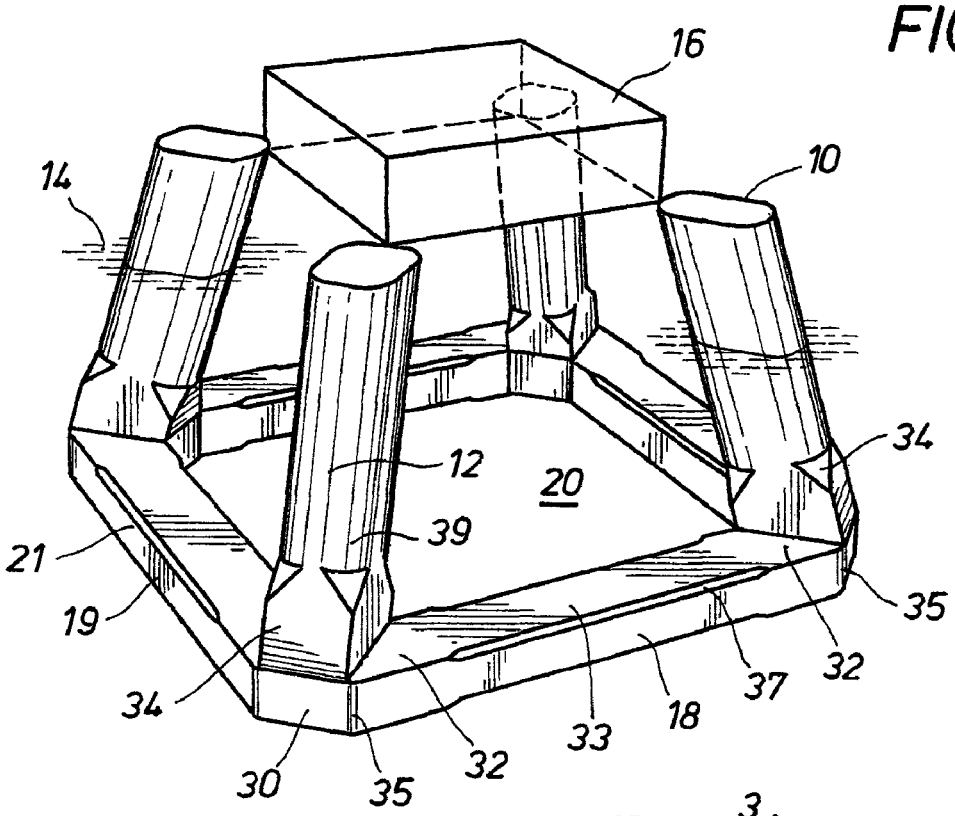
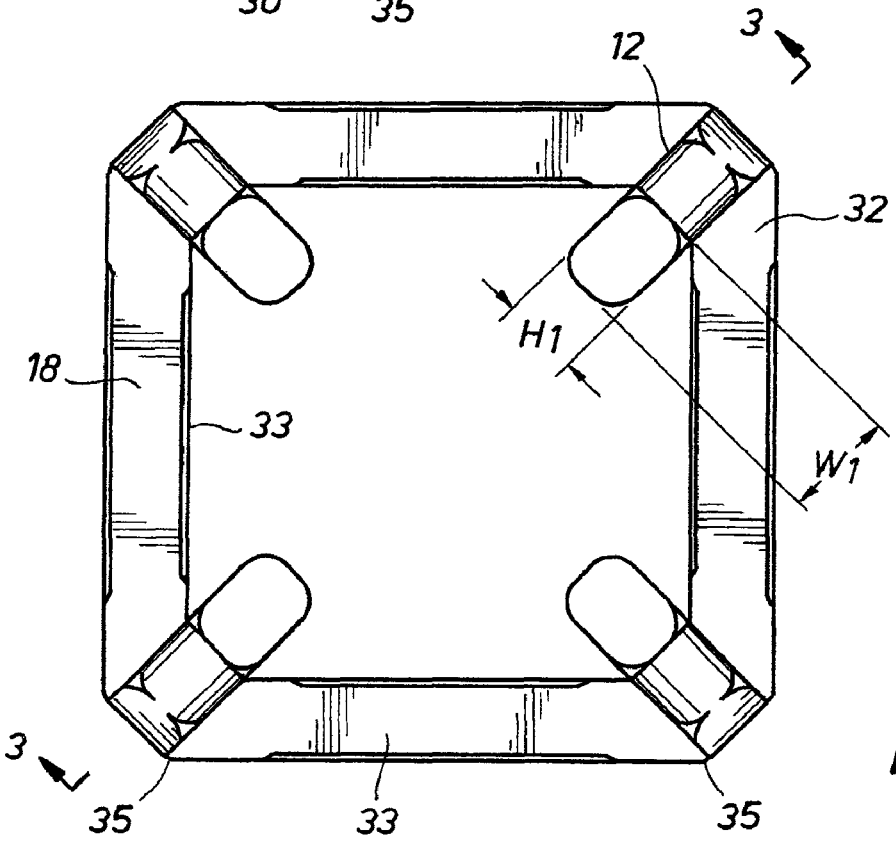
FIG. 2

BATTERED COLUMN SEMI-SUBMERSIBLE OFFSHORE PLATFORM

CROSS-REFERENCE TO RELATED APPLICATION

This application is a continuation of U.S. application Ser. No. 11/868,960, filed Oct. 8, 2007, now abandoned.

BACKGROUND OF THE DISCLOSURE

The present invention relates to offshore floating platforms, more particularly to a semi-submersible offshore platform for installation and use in deep water offshore operations.

Semi-submersible offshore platforms are connected to sub-sea wellheads and other installations via Steel Catenary Risers (SCR), also commonly referred to as risers or riser pipes. In deep water installations, the SCR are thousands of feet in length. SCR are stressed by platform motion caused by wave action and suffer fatigue damage during each stress cycle.

An improvement in the motion performance of a semisubmersible platform may be obtained by battering the deck support columns, thereby reducing SCR stresses. Furthermore, battering the deck support columns increases the free floating stability of the semisubmersible platform, and reduces the overall system costs.

SUMMARY OF THE INVENTION

In accordance with a preferred embodiment of the present invention, a semisubmersible platform includes a deck supported on the upper ends of support columns interconnected at the lower ends thereof by a horizontally disposed pontoon-ring. The columns are battered inwardly from the pontoon-ring to the deck. The outer perimeter dimension of the deck is smaller than the outer perimeter dimension of the pontoon-ring which also facilitates installation of SCR on the inside or outside faces of the pontoon-ring. The battered columns improve platform stability during free floating transportation and installation operations by providing a larger restoring moment at shallower drafts.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 1 is a perspective view illustrating a preferred embodiment of a battered column semisubmersible platform of the present invention;

FIG. 2 is a top plan view of the battered column semisubmersible platform shown in FIG. 1;

DETAILED DESCRIPTION OF A PREFERRED EMBODIMENT

Figure 3:
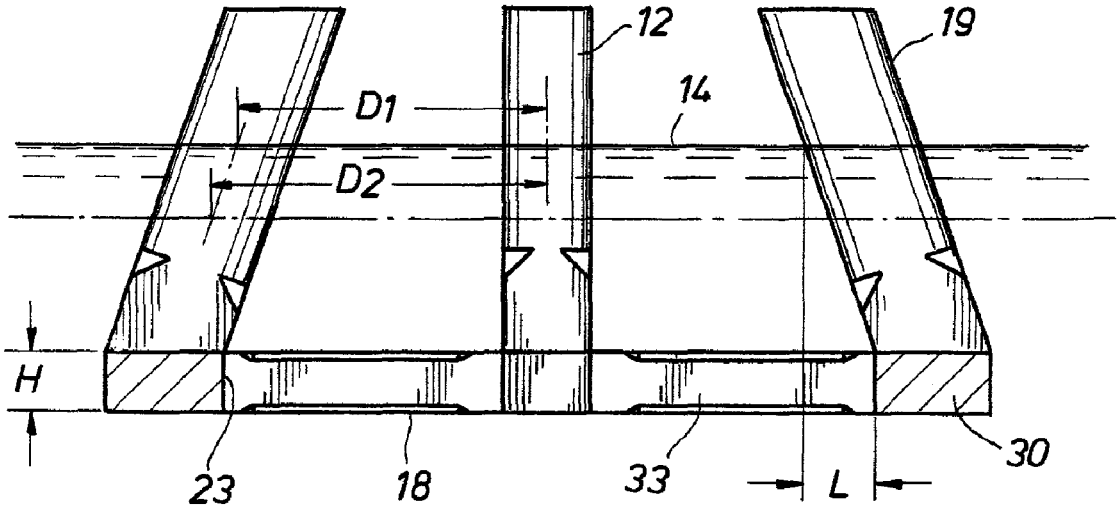
FIG. 3 is a section view taken along line 3-3 of FIG. 2.

Referring first to FIG. 1, a preferred embodiment of a battered column semisubmersible platform in accordance with the present invention is generally identified by the reference numeral 10. The platform 10 includes four columns 12 having upper ends projecting above the water surface 14 for engaging and supporting a platform deck 16 thereon. Horizontally disposed pontoons 18 interconnected by base nodes 30 enclose a central opening 20.

The columns 12 and pontoons 18 form an open structure hull 19 for supporting the deck 16 and the equipment mounted thereon above the water surface 14. The open structure of the hull 19 provides improved wave transparency and access to the seabed from the deck 16 through the hull 19. The columns 12 and base nodes 30 form the corners of the hull 19. The four support columns 12 extend upwardly from the base nodes 30 to the deck 16. The columns 12 are battered or inclined inwardly toward the central vertical axis of the hull 19. Preferably, the columns 12 are battered inwardly at an angle less than 20 degrees from vertical.

Figure 4:
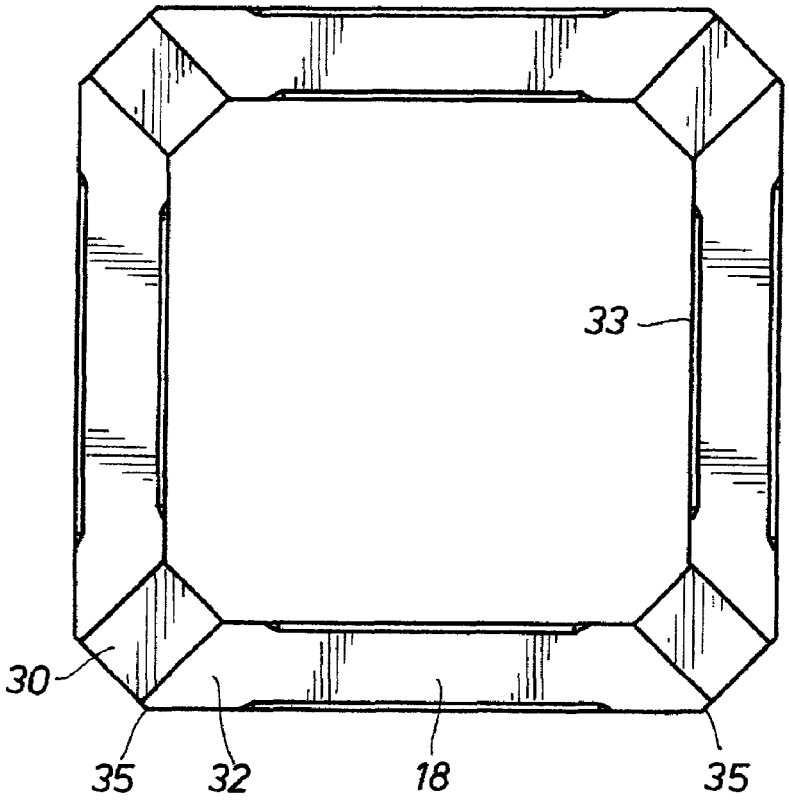
FIG. 4 is a top plan view of the pontoon ring of the battered column semisubmersible platform shown in FIG. 1.

The pontoons 18 and base nodes 30 form a substantially rectangular pontoon-ring 21 as best shown in FIG. 4. The four corners of the pontoon ring 21 are defined by the box-like base nodes 30. The base nodes 30 are the same height H as the pontoons 18. The sidewalls 23 of the base nodes 30 define a flat planar surface for welding or otherwise securing the ends of the pontoons 18 to the base nodes 30 to form the pontoon-ring 21.

The configuration of the pontoons 18 may vary to accommodate the requirements of any specific platform design. Referring now to FIGS. 1-4, it will be observed that the pontoons 18 include end portions 32 and an intermediate portion 33 between the end portions 32. The longitudinal corners 37 of the intermediate portion 33 of the pontoons 18 are rounded for reducing the drag loads acting on the pontoons 18. As noted above, the height H of the pontoons 18 is the same as the height of the base nodes 30. However, the width dimension of the intermediate portion 33 of pontoons 18 is determined to accommodate the buoyancy and/or heave dampening requirements of a platform design. Depending on the dimension of the intermediate portion 33 of pontoon 18, the vertical internal and/or vertical external wall of the pontoon 18 may have an arcuate section 35, in order for the end cross-section of the pontoon 18 to match the side profile of the base node 30 defined by sidewalls 23.

Referring now to FIGS. 2 and 3, the support columns 12 extend upwardly from the base nodes 30 of the hull 19. The support columns 12 are inclined radially inwardly toward the center vertical axis of the hull 19 and extend upwardly from the base nodes 30 to the deck 16. The columns 12 are substantially rectangular in cross section with an aspect ratio ($W_1/H_1$) of about 1.4. The corners 39 of the columns 12 are rounded for reducing the drag loads acting on the columns 12. The rounded corners also reduce the magnitude of wave run up on the columns 12. The columns 12 further include a transition portion 34 terminating at the lower ends thereof so that the lower ends of the columns 12 define an end cross-section substantially matching the profile of the top surface of the base nodes 30.

The transition portions 34 of the columns 12, and the base nodes 30 of the pontoons 18 define a smooth load path down the columns 12 into the base nodes 30 and pontoons 18. The transition portions 34 of the columns 12 merge or morph into the base nodes 30 of the pontoons 18, thereby providing continuity of load path from the deck 16 to the pontoons 18.

The payload carrying capacity of a semisubmersible platform system is limited by the hull displacement and its free floating stability. Battering the columns 12 increases the free floating stability at the platform operating draft, thereby increasing the payload carrying capacity of the semisubmersible for substantially the same overall displacement and columns/pontoons displacement ratios.

Various modes of transportation may be utilized to transport a semisubmersible platform or components thereof to an installation site. When the hull and deck are assembled at the fabrication yard, the hull-and-deck assembly may be free floated to the installation site. For free floating conditions of the hull-and-deck assembly (such as deck integration, loading and unloading from a transport vessel, and towing to the installation site), hydrostatic stability is most lacking at shallow draft when the vertical center of gravity of the hull-and-deck assembly is high. The battered columns 12 of the semisubmersible platform 10 provide a larger restoring moment at shallower drafts of the free floating hull-and-deck assembly than a conventional semisubmersible platform with vertical columns. The restoring moment is directly proportional to the cross sectional area of the columns 12, and their horizontal distance to the center vertical axis of the platform 10.

As best illustrated in FIG. 2, the restoring moment of the hull 19 at the water surface 14 for a first draft position (e.g. operating draft) is proportional to the distance $D_1$. At a shallower second draft position (e.g. transportation draft), the restoring moment of the hull 19 is proportional to the distance $D_2$. Unlike the restoring moment of a conventional semisubmersible platform, which is the same at all drafts, the restoring moment of the battered column semisubmersible platform 10 increases at shallower drafts of the free floating hull-and-deck assembly. The battered columns 12 therefore provide additional restoring moment for maximizing the stability of the semisubmersible platform 10 at shallower drafts where the center of gravity of the platform 10 is located at a higher elevation and more restoring moment is needed, and thereby maximizing the payload capacity of the deck 16 during various phases of the installation and operation of the semisubmersible platform 10. Increased stability at shallower drafts is desirable because this allows the deck and hull unit to be completed quayside and transported free-floating to the installation site Inclination of the columns 12 also imparts pontoon-like properties to the columns 12. The pontoon component of the columns 12 is proportional to length L of the horizontal projection of the portion of the column 12 submerged below the water surface 14. The pontoon component of the columns 12 result in an increase in the vertical component of apparent mass, thereby improving the motion characteristics of the semisubmersible platform in waves.

Battering the columns 12 also contributes to a reduction in the horizontal loading on the columns 12 due to wave run up on the columns 12. Battering the columns 12 break up wave load phasing on the inclined surface of the columns 12 resulting in a reduction in horizontal loading on the platform.

It will be observed that the columns 12 and pontoons 18 are depicted as substantially rectangular members and the pontoon-ring configuration as substantially retangular. However, it is to be understood that the disclosed embodiment is merely exemplary of the invention that may be embodied in various and alternative forms and not intended to be limiting.

While a preferred embodiment of the invention has been shown and described, other and further embodiments of the invention may be devised without departing from the basic scope thereof, and the scope thereof is determined by the claims which follow.

The invention claimed is:

1. A semisubmersible floating platform, comprising:

a) horizontally disposed pontoons interconnected by base nodes to form a substantially rectangular pontoon-ring, said base nodes having a height profile substantially matching the height profile of said pontoons;

b) said pontoons including oppositely facing distal ends and an intermediate pontoon portion extending therebetween, wherein said pontoons include an arcuate sidewall portion proximate said distal ends thereof, said arcuate sidewall portion disposed outwardly relative to adjacent one of said base nodes, and wherein said arcuate sidewall portion converges inwardly in a vertical plane toward said adjacent one of said base nodes so that said arcuate sidewall portion terminates at said distal ends of said pontoons forming a vertical edge of a pontoon end cross-section substantially matching the profile of a side surface of said base nodes; and c) at least four support columns battered radially inwardly toward the center vertical axis of said platform extending upwardly from said base nodes to a deck supported above a water surface, each of said support columns including an upper end and a lower end, wherein said lower end of each of said support columns includes a downwardly and outwardly extending transition portion defining a column end cross-section substantially matching the profile of a top surface of said base nodes.

2. The platform of claim 1 wherein said support columns, said base nodes and said pontoons define a continuous load path between said deck and said pontoon-ring.

3. The platform of claim 1 wherein said battered columns support said deck inboard of an outer face of said pontoon ring.

4. The platform of claim 1 wherein said battered columns incline inwardly at an angle less than about 20 degrees from vertical.

5. The platform of claim 1 wherein the restoring moment of said platform increases as the draft of said platform decreases.

6. The platform of claim 1 wherein said battered columns have an aspect ratio of about 1.4.

7. The platform of claim 1 wherein said battered columns are substantially rectangular in cross section with rounded corners.

* * * * *